United States Patent [19]

Burton, III et al.

[11] 4,133,380

[45] Jan. 9, 1979

[54] ESTABLISHING A COMBUSTION ZONE BELOW A SILL PILLAR IN AN IN SITU OIL SHALE RETORT

[75] Inventors: Robert S. Burton, III; Carlon C. Chambers; Robert F. Hughes, all of Grand Junction, Colo.

[73] Assignee: Occidental Oil Shale, Grand Junction, Colo.

[21] Appl. No.: 814,481

[22] Filed: Jul. 11, 1977

[51] Int. Cl.[2] ..... E21B 43/24; E21B 43/26

[52] U.S. Cl. ..... 166/259; 299/2

[58] Field of Search ..... 299/2, 4; 166/256, 259, 166/260, 261, 262, 302, 251, 247

[56] References Cited

U.S. PATENT DOCUMENTS

| | | | |
|---|---|---|---|
| 2,630,306 | 3/1953 | Evans | 299/2 |
| 2,801,089 | 7/1957 | Scott, Jr. | 299/2 |
| 3,499,489 | 3/1970 | Parker | 166/260 X |
| 4,007,963 | 2/1977 | Ridley | 166/260 |
| 4,018,280 | 4/1977 | Daviduk et al. | 299/2 |
| 4,027,917 | 6/1977 | Bartel et al. | 166/260 X |
| 4,043,595 | 8/1977 | French | 299/2 |

FOREIGN PATENT DOCUMENTS

| | | | |
|---|---|---|---|
| 762484 | 11/1956 | United Kingdom | 299/2 |

*Primary Examiner*—Stephen J. Novosad
*Attorney, Agent, or Firm*—Christie, Parker & Hale

[57] ABSTRACT

An in situ oil shale retort is formed in a subterranean formation containing oil shale. The retort contains a fragmented permeable mass of particles containing oil shale. An open base of operation is excavated in the formation above the retort site, and an access drift is excavated to the bottom of the retort site. Formation is explosively expanded to form the fragmented mass between the access drift and an elevation spaced below the bottom of the base of operation, leaving a horizontal sill pillar of unfragmented formation between the top of the fragmented mass and the bottom of the base of operation. The sill pillar provides a safe base of operation above the fragmented mass after it is formed. The fragmented mass is formed by, among other steps, drilling blasting holes from the base of operation down through the sill pillar and detonating explosive in the holes to form the fragmented mass of particles in the retort below the sill pillar. The fragmented mass is ignited through at least a first one of such blasting holes to establish a combustion zone in the top of the fragmented mass. The combustion zone is then advanced across the top of the fragmented mass by generating a gas pressure differential between the first blasting hole and at least a second blasting hole to draw gas down through the first blasting hole, across a top portion of the fragmented mass, and up through a second blasting hole so that gas flow across an upper portion of the fragmented mass spreads the combustion zone across the fragmented mass.

23 Claims, 4 Drawing Figures

ESTABLISHING A COMBUSTION ZONE BELOW A SILL PILLAR IN AN IN SITU OIL SHALE RETORT

BACKGROUND OF THE INVENTION

This application is related to U.S. Pat. Application Ser. No. 603,704 entitled "In Situ Recovery of Shale Oil", filed Aug. 11, 1975 by Gordon B. French , now U.S. Pat. No. 4,043,595 to U.S. Pat. Application Ser. No. 603,705 entitled "Forming Shale Oil Recovery Retort Into Slot-Shaped Columnar Void", filed Aug. 11, 1975 by Richard D. Ridley, now U.S. Pat. No. 4,043,596, and to U.S. Pat. Application Ser. No. 790,350, entitled "In Situ Oil Shale Retort With a Horizontal Sill Pillar", filed Apr. 25, 1977, by Ned M. Hutchins. All three of these applications are assigned to the assignee of the present application and are incorporated herein by this reference.

This invention relates to recovery of liquid and gaseous products from oil shale. The term "oil shale" as used in the industry is in fact a misnomer; it is neither shale, nor does it contain oil. It is a sedimentary formation comprising marlstone deposit with layers containing an organic polymer called "kerogen" which upon heating decomposes to produce hydrocarbon liquid and gaseous products. The formation containing kerogen is called "oil shale" herein, and the hydrocarbon liquid product is called "shale oil".

One technique for recovering shale oil includes forming an in situ oil shale retort in a subterranean formation containing oil shale. At least a portion of the formation within the boundaries of the in situ oil shale retort is explosively expanded to form a fragmented permeable mass of particles containing oil shale. The fragmented mass is ignited near the top of the retort to establish a combustion zone. An oxygen-containing gas is introduced into the top of the retort to sustain the combustion zone and cause it to move downwardly through the fragmented permeable mass of particles in the retort. As burning proceeds, the heat of combustion is transferred to the fragmented mass of particles below the combustion zone to release shale oil and gaseous products therefrom in a retorting and vaporization zone. Vaporized constituuents of shale oil, water vapor and the like may condense on cooler oil shale in the retort below the retorting zone. The retorting zone moves from top to bottom of the retort ahead of the combustion zone, and the resulting shale oil and gaseous products pass to the bottom of the retort for collection and removal. Recovery of liquid and gaseous products from oil shale deposits is described in greater detail in U.S. Pat. No. 3,661,423, to Donald E. Garrett, assigned to the assignee of this application.

In preparing for the retorting process the formation containing oil shale should be fragmented rather than simply fractured to create good and uniform permeability so that undue pressures are not required to pass the gas through the retort, and so that valuable deposits of oil shale are not bypassed owing to non-uniform permeability. The aforementioned patent applications disclose techniques for fragmenting a substantial volume of formation in a retort site to form a fragmented mass of particles in an in situ oil shale retort. The in situ retort is formed by excavating a void in the retort site, drilling blasting holes into the remaining portion of the formation in the retort site, loading explosive into the blasting holes, and detonating the explosive to expand the formation toward the void.

To promote uniformity of particle size and permeability of the fragmented mass, and to minimize the quantity of explosives, the blasting holes should be reasonably accurately located with respect to each other, and with respect to the void toward which expansion occurs during the explosion. Oil shale formations in the western United States are often between 50 to about 500 feet thick or even more, and are covered by a non-productive overburden, which may be thousands of feet deep, thus often making it difficult to drill from the surface and accurately locate blasting holes in the oil shale formation.

In one embodiment disclosed in application Ser. No. 790,350, and entitled "In Situ Oil Shale Retort With A Horizontal Sill Pillar", an open base of operation is excavated in the formation at a working level near the top of an in situ retort to be formed, which may be a thousand feet, or more, below the ground surface. A substantially horizontal access drift is excavated at a production level below the base of operation to provide access to a lower portion of the retort site. A void is excavated above the access drift so the void opens into the access drift and terminates below the base of operation at the top of the fragmented mass being formed. This leaves a substantially horizontal portion of intact formation between the top of the void and the bottom of the base of operation. The blasting holes for explosive for expanding formation are drilled from the base of operation through the formation on opposite sides of the void. Inasmuch as the working level is much closer to the top of the retort being formed than the distance from the retort to the overburden at the ground surface, this permits more accurate and rapid drilling of blasting holes from the base of operation than from the ground surface. This, in turn, facilitates explosive expansion to form the fragmented mass of oil shale particles in the retort.

In an embodiment disclosed in application Ser. No. 790,350, a horizontal sill pillar of unfragmented formation remains between the top of the fragmented mass in the retort and the bottom of the base of operation. The sill pillar has a number of bore holes through it after formation of the fragmented mass. Such bore holes include the upper ends of blasting holes drilled from the base of operation. Such bore holes can be used for access from the base of operation for establishing and sustaining a combustion zone in the fragmented mass below the sill pillar.

In the past a variety of techniques have been developed for igniting oil shale particles in an in situ retort in order to establish a combustion zone. One such technique is disclosed in U.S. Pat. application Ser. No. 578,203, filed May 16, 1975, and now U.S. Pat. No. 4,027,917, and U.S. Pat. No. 3,952,801, issued Apr. 27, 1976, to Robert S. Burton, III, and assigned to the assignee of this application. According to the techniques disclosed in these patents, a hole is bored to the top of the fragmented permeable mass and a burner is lowered through the bore hole to the oil shale to be ignited. A mixture of a combustible fuel such as LPG (liquefied petroleum gas) and oxygen containing gas such as air, is burned in the burner, and the resultant flame is directed downwardly toward the fragmented permeable mass. The burning is conducted until a substantial portion portion of the oil shale has been heated above its ignition temperature so that combustion of the oil shale in the fragmented mass is self-sustaining. After ignition an oxygen supplying gas is introduced to the retort to advance the combustion zone through the fragmented mass.

It can be time consuming to establish a combustion zone in an oil shale retort. For example, a startup time as long as a week has been experienced with a retort in the South/Southwest portion of the Piceance Creek structural basin in Colorado. Such a long startup time results in consumption of large quantities of LPG, an expensive, premium fuel.

An in situ oil shale retort can have a substantial lateral extent. For example, it can be square with a lateral dimension of 120 feet or more. In such a large retort, a large number of burners and bore holes to various portions of the top of the retort and large quantities of fuel such as LPG can be required for establishing a combustion zone in the retort. Preparation of a large number of bore holes and use of a large number of burners and large quantities of LPG can contribute significantly to the cost of producing hydrocarbon products from oil shale.

If a combustion zone is not properly established across the top of the retort, the resulting combustion zone can be skewed and/or warped. It is desired to establish and maintain a combustion zone which is flat and uniformly transverse to the direction of its advancement to maximize yield of hydrocarbon products from the oil shale in an in situ oil shale retort. If the combustion zone is skewed relative to its direction of advancement, there is more tendency for oxygen present in the combustion zone to migrate into the retorting zone, thereby oxidizing hydrocarbon products produced in the retorting zone and reducing hydrocarbon yield. In addition, with a skewed and/or warped combustion zone, excessive cracking of hydrocarbon products produced in the retorting zone can result.

Around each locus of ignition in the fragmented mass, a combustion zone is formed which tends to advance downwardly and laterally in the fragmented permeable mass. The combustion zone advances downwardly through the fragmented mass primarily by gas flowing through the fragmented mass, and it advances laterally and radially in the fragmented mass primarily by conduction and radiation. Inasmuch as heat transfer by conduction and radiation through a fragmented mass is slower than heat transfer by gas flow, a substantial amount of unretorted oil shale can be left in the "corners" or outer regions adjacent the boundaries of the fragmented mass. This can significantly reduce the yield of hydrocarbons obtained from the retort.

Thus, it is desirable to provide a method for establishing in a combustion zone in an in situ oil shale retort which effectively reduces startup time, as well as labor, fuel, energy and/or equipment costs. Moreover, it is desirable to provide a method which effectively initiates combustion so that the resulting combustion zone will be essentially flat and transverse to its direction of advancement, without leaving substantial amounts of unretorted oil shale in the top of the fragmented mass.

SUMMARY OF THE INVENTION

This invention provides a method for igniting an in situ oil shale retort in a subterranean formation containing oil shale. The retort contains a fragmented permeable mass of formation particles containing oil shale, and the fragmented mass has top, bottom and side boundaries. According to the method of this invention, a combustion zone is established in the fragmented mass adjacent the top boundary. An oxygen containing gas is introduced into the combustion zone for combustion of carbonaceous materials in oil shale and for producing combustion gas. Combustion gas is withdrawn from the fragmented mass adjacent the top boundary at a location remote from the combustion zone for advancing the combustion zone laterally in the fragmented mass. Thereafter, combustion gas is withdrawn from the fragmented mass adjacent the bottom boundary for advancing the combustion zone downwardly through the fragmented mass.

Preferably, the in situ oil shale retort includes an open base of operation at an elevation above the top boundary of the fragmented mass, and a horizontal sill pillar of unfragmented formation between the top boundary of the fragmented mass and the bottom of the base of operation. A plurality of bore holes extend through the sill pillar from the base of operation to the fragmented mass. A combustion zone is established in the fragmented mass adjacent a first bore hole. Gas is withdrawn from a second bore hole through the sill pillar to draw gas down through the first bore hole through the sill pillar in the vicinity of the combustion zone, across an upper portion of the fragmented mass, and up through the second bore hole so that gas flow across an upper portion of the fragmented mass and spreads the combustion zone across the fragmented mass.

Gas flow for spreading the combustion zone is preferably generated by producing a gas pressure differential between the first and second bore holes which draws gas from the base of operation, down through the first bore hole, across the top of the fragmented mass, and then up through the second bore hole. Gas pressure at the second bore hole is preferably less than air pressure in the base of operation.

DRAWINGS

These and other aspects of the invention will be more fully understood by referring to the following detailed description and the accompanying drawings in which.

Figure 2:
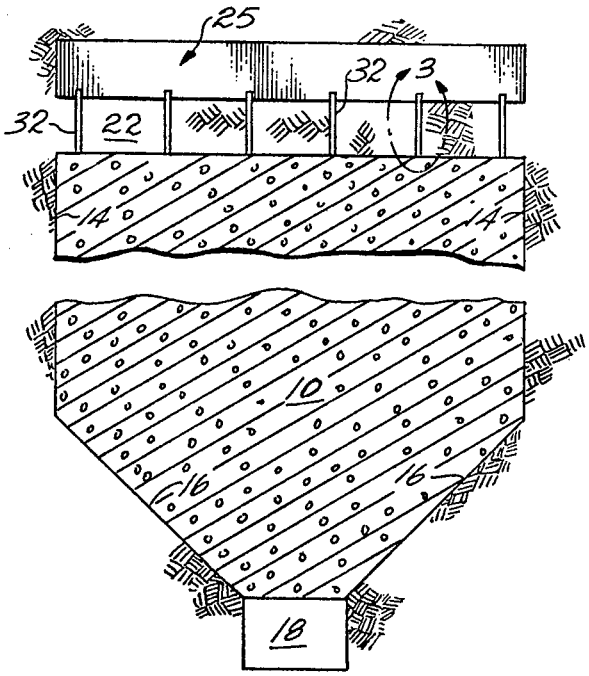
FIG. 2 is a horizontal cross-sectional view taken on line 2—2 of FIG. 1.
Figure 3:
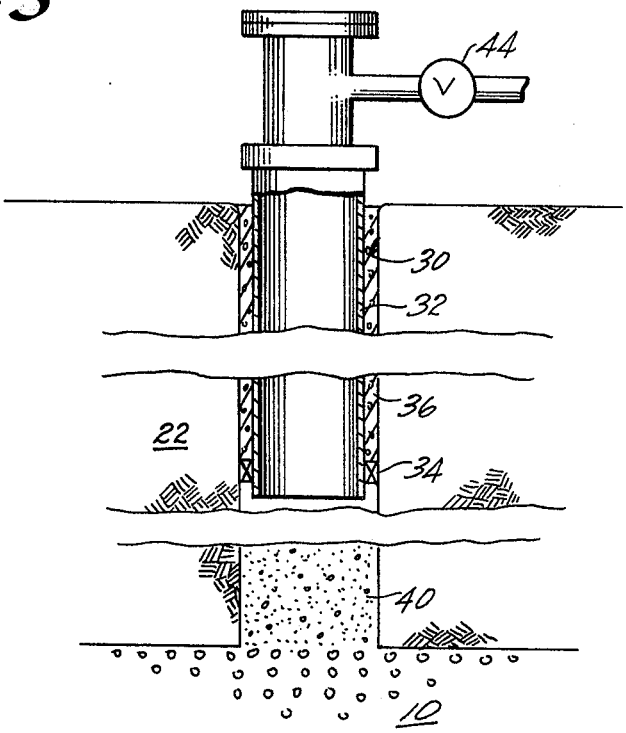
Figure 4:
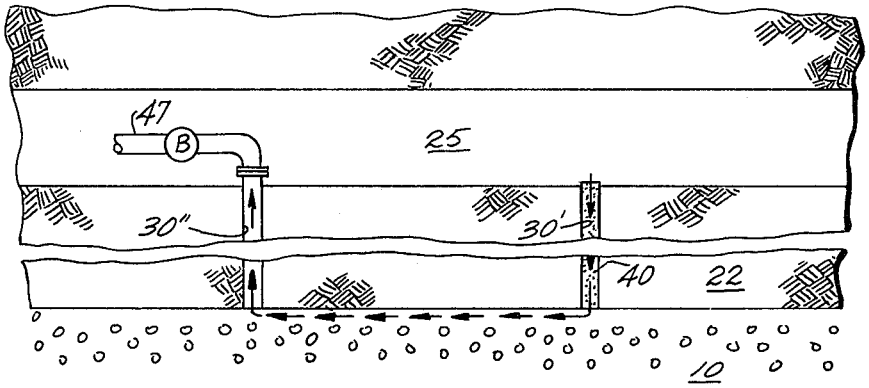

FIG. 3 is an enlarged, semi-schematic cross-sectional view taken within the circle 3 of FIG. 2 and showing a casing filled with combustible materials and located in a blasting hole extending through a horizontal sill pillar over the in situ retort; and FIG. 4 is a fragmentary semi-schematic vertical cross-sectional view illustrating a method of establishing a combustion zone in the in situ retort according to principles of this invention.

DESCRIPTION

General Description of Retort Forming

An in situ oil shale retort has a base of operation formed on a working level in a subterranean formation. This working level is at an upper elevation near the top of a retort being formed. A fragmented permeable mass of particles containing oil shale is formed below the base of operation by explosive expansion of formation toward an excavated void. The bottom of the base of operation is separated from the top boundary of the fragmented mass by a horizontal sill pillar of unfragmented formation. The horizontal sill pillar is sufficiently thick that it withstands stresses imposed by explosive expansion, as well as geologic stresses, to provide a safe base of operation after formation of the fragmented mass. This permits men and equipment to enter the base of operation over the top of the fragmented mass after explosive expansion. The base of operation on the working level can have a horizontal extent that permits effective access over substantially the entire horizontal cross-section of the fragmented mass, which is of great assistance in forming and operating an in situ retort.

After explosive expansion the base or operation is convenient as a location from which to ignite an upper portion of the fragmented mass and to control gas flow through the fragmented mass so as to establish and maintain a uniform combustion zone in the fragmented mass.

In one method of forming an in situ oil shale retort in a subterranean formation containing oil shale, a portion of the formation is excavated to form a base of operation on an upper working level. A drift or similar means of access is excavated through formation at a lower production level to a location underlying the base of operation at or below the bottom of the in situ retort.

In preparing such a retort, at least one void is excavated from within the boundaries of the fragmented mass being formed, the void being connected to the access drift on the production level underlying the base of operation. This leaves another portion of the formation within the boundaries of the retort being formed which is to be fragmented by explosive expansion toward such void. This void is excavated only to an elevation above the access drift that leaves a horizontal sill pillar of intact formation between the top of the void and the bottom of the base of operation. The surface of the formation defining the void provides at least one free face which extends through the formation, and the remaining portion of the formation within the boundaries of the retort being formed is explosively expanded toward such a free face.

In a preferred embodiment, the horizontal extent of the base of operation over the fragmented mass in the in situ retort is sufficient to provide effective access to substantially the entire horizontal cross-section of the fragmented mass. This does not require that there be an open excavation over the entire horizontal extent of the fragmented mass. Roof-supporting pillars can be left on the working level in a portion of the area directly above the fragmented mass. The size and arrangement of such working level pillars leaves an open base of operation having a sufficient horizontal extent to provide access to substantially the entire horizontal cross-section of the retort site. Such a base of operation facilitates excavation operations for forming a void for drilling and explosive loading for explosive expansion of formation toward such a void, and for introduction of oxygen containing gas into the top of the fragmented mass below the horizontal sill pillar.

In one embodiment, a plurality of vertically extending blasting holes are drilled through the sill pillar into formation remaining below the sill pillar. Explosive is loaded into such blasting holes from the base of operation up to a level about the same as the bottom of the horizontal sill pillar, which is to remain unfragmented. Such explosive is detonated for explosively expanding subterranean formation toward such void below the sill pillar and forming a fragmented mass of formation particles in the retort while leaving unfragmented formation forming the sill pillar.

The base of operation can be used as a location from which to initiate and control advancement of a combustion zone through the retort. According to the present invention, the flow of gas to the retort is controlled from the base of operation in order to establish such a combustion zone in the retort.

Detailed Description

Figure 1:
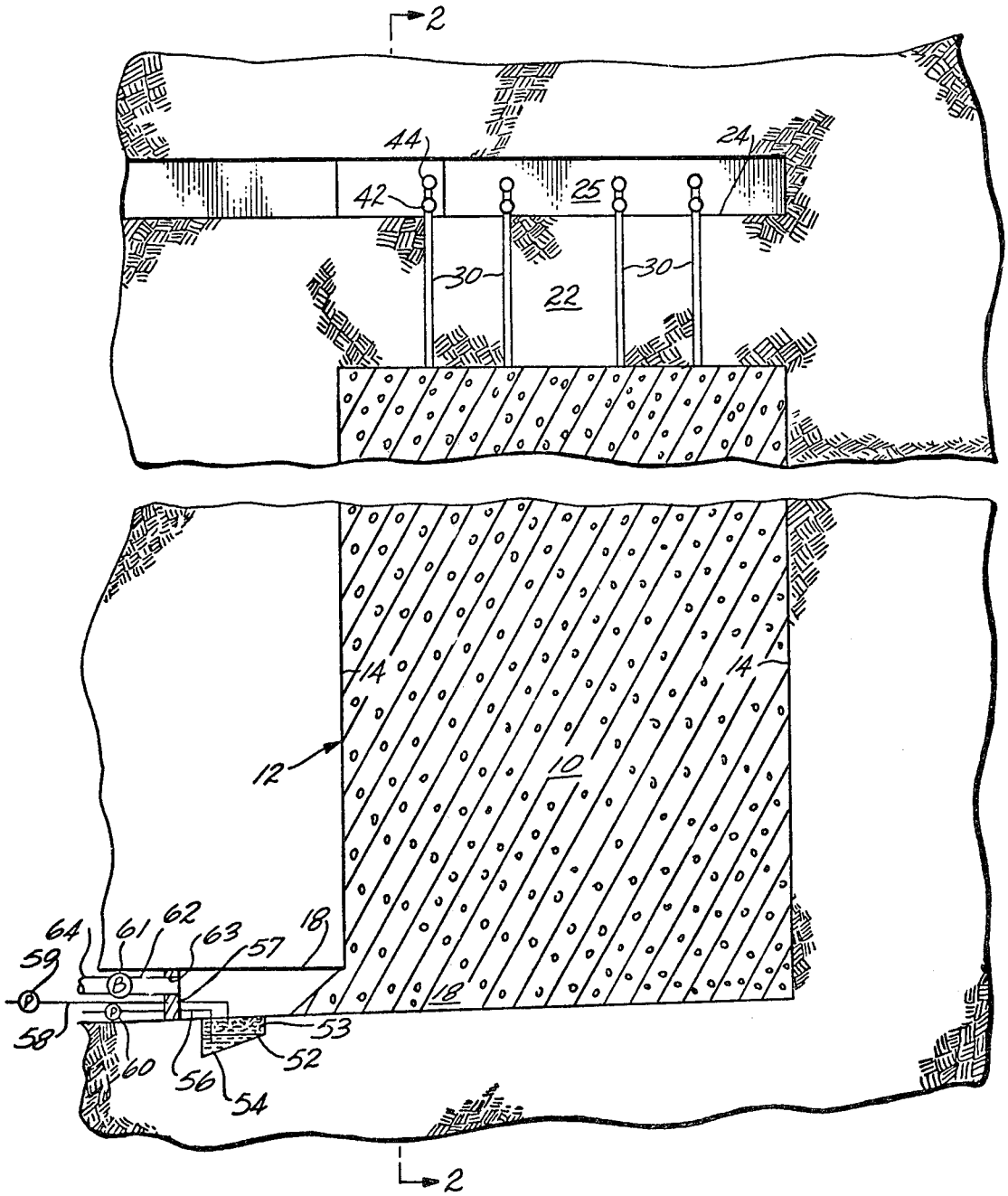
FIG. 1 is a semi-schematic vertical cross-sectional view showing one embodiment of an in situ oil shale retort constructed and operated in accordance with principles of this invention.

Referring to FIGS. 1 and 2, a fragmented permeable mass 10 of formation particles containing oil shale fills an in situ oil shale retort 12 in a subterranean formation containing oil shale. The fragmented permeable mass has vertical side boundaries 14 substantially perpendicular to each other to give the retort a rectangular horizontal cross-section. The lower boundary 16 of the fragmented permeable mass slopes downwardly and inwardly (see FIG. 2) at an angle of about 45° and opens into the top of an elongated, substantially horizontal access drift 18 at the bottom of the retort 12. The access drift 18 has a gradual slope downwardly from the center of the bottom of the retort toward a sump 52 for recovering liquid products of retorting at the production level. The fragmented permeable mass also fills the portion of the access drift beneath the retort.

A horizontal sill pillar 22 of unfragmented formation forms the upper boundary 23 of the fragmented permeable mass in the retort. The top of the sill pillar 22 forms the floor 24 of an open base of operation 25 spaced above the fragmented mass by a distance equal to the thickness of the sill pillar. In this embodiment the base of operation 25 is an excavation about 12 to 14 feet high at a working level above the retort. It extends substantially entirely over the horizontal cross-section of retort, and opens at the left (as viewed in FIG. 1) to other excavations at the working level used for exploiting the oil shale deposit. Such underground workings open to a vertical shaft or horizontal adit (not shown).

A plurality of vertical blasting holes 30 extend through the sill pillar 22. The blasting holes remain in the sill pillar after the blasting which formed the fragmented mass in the retort. The blasting holes 30 are generally uniformly distributed over the area of the sill pillar 22. In a working embodiment, the horizontal cross-section of the fragmented permeable mass 10 is square, each side being about 120 feet long; and the blasting holes are located at intervals of about 25 feet and about 30 feet in a rectangular grid. The presently preferred blasting operation will be described briefly below, and it is described in detail in U.S. Patent Application Ser. No. 790,350, filed Apr. 25, 1977, and entitled "In Situ Oil Shale Retort With A Horizontal Sill Pillar".

During operation of the retort, an oxygen containing gas used for retorting of the oil shale is passed downwardly through the fragmented mass. The gas is introduced into an upper portion of the fragmented permeable mass. The production level drift 18 provides a means for collecting and recovering liquid products and withdrawing off gas containing gaseous products from retorting oil shale in the retort 10. A variety of retorting techniques can be used, some of which are set forth in the prior art, so no further description of them is needed for one skilled in the art.

According to the present invention, the base of operation 25 is used as a location from which to establish a combustion zone in the retort and to spread the combustion zone across the top of the retort. The blasting holes 30 are used as a means for gaining access to the upper region of the retort to initiate combustion in the retort. A separate vertical steel casing 32 is disposed in each blasting hole prior to using the blasting holes to ignite the oil shale. A conventional external packer 34 at the lower end of each casing seals against the casing exterior and the adjacent portion of the horizontal sill pillar 22. The annular space between the casing and the sill pillar above the packer is filled with cement 36 which anchors the casing securely in the sill pillar. In some cases, each casing can be adequately secured by using only the packer, or the cement can be replaced by drilling mud or the like to facilitate removal of the casing after the fragmented oil shale in the retort is completely treated.

A sump 52 in the region of the access drift 18 beyond the fragmented mass collects shale oil 53 and water 54 produced during operation of the retort. A water withdrawal line 56 extends from near the bottom of the sump out through a sealed opening (not shown) in a vertical barrier or bulkhead 57 sealed across the access drift. The water withdrawal line 56 is connected to a water pump 60. An oil withdrawal line 58 extends from an intermediate level in the sump out through a sealed opening (not shown) in the barrier and is connected to an oil pump 59. The oil and water pumps can be operated manually or by automatic controls (not shown) to remove oil and water separately from the sump.

The inlet of a blower 61 is connected by a conduit 62 to an opening 63 through the barrier 57 for withdrawing off gas from the retort. The outlet end of the blower delivers off gas from the retort through a conduit 64 to a recovery or disposal system (not shown). Thus, the access drift 18 provides means for collecting and recovering liquid and gaseous products from the in situ oil shale retort.

The top of the fragmented mass 10 can be ignited through any of the plurality of blasting holes 30 in the sill pillar 22. Although a plurality of combustion zones can be established in the fragmented mass below a plurality of the blasting holes, a method including practice of this invention is described in the context of a single combustion zone being established in the fragmented mass below a first blasting hole 30′ shown in FIG. 4. The fragmented mass can be ignited by any suitable means, such as by lowering a burner through an open first blasting hole 30′ from the base of operation to heat a portion of the fragmented mass to a temperature greater than the ignition temperature of oil shale until a combustion zone in the fragmented mass can be sustained by introduction of oxygen containing gas.

One method of igniting the oil shale is to initially place particles of a solid combustible material 40 in the blasting hole 30′. The combustible material is ignited to generate a heated ignition gas used to ignite the fragmented mass. The blasting hole 30′ is filled with the combustible material. The combustible material 40 can be a solid fuel such as coal, charcoal, gelled shale oil, peat, high grade oil shale, sawdust, or the like.

The bed of combustible material 40 in the blasting hole 30′ is sufficiently permeable to allow an oxygen-containing gas to flow down through the combustible material and into the top of the retort. Preferably, the combustible material in the blasting hole is ignited from a location within the base of operation 25, and gas is then drawn down through the ignited combustible material to generate a heated ignition gas which is introduced from the blasting hole 30′ to the top of the fragmented mass 10.

The air flow through the ignited combustible material 40 for generating the heated ignition gas in the first blasting hole 30′ is generated by a blower 46 connected to a second open blasting hole 30″ spaced horizontally from the first blasting hole 30′. The blower 46 is shown located in the base of operation. The blower is connected to a conduit 47 extending from the top of the second blasting hole 30″ to the outside of the formation. Alternatively, the blower 46 could be located outside the formation and connected to a conduit extending to the top of the second blasting hole 30″. By operating the blower 46, a gas pressure differential is produced between the second blasting hole 30″ and the first blasting hole 30′. This gas pressure differential draws air from the base of operation down through the combustible material 40 in the first blasting hole 30′, and draws ignition gas across an upper portion of the fragmented mass and up through the second blasting hole 30″ as illustrated by the arrows in FIG. 4. The air flow down through the ignited combustible material in the first blasting hole 30′ generates a heated ignition gas which is drawn into contact with the fragmented mass at the top of the retort. The heated ignition gas heats particles containing oil shale to a temperature greater than the spontaneous ignition temperature of carbonaceous materials in the fragmented mass.

After heating a sufficient portion of the fragmented mass to a temperature which will sustain a combustion zone, carbonaceous materials in the fragmented mass are contacted with air drawn through the first blasting hole 30′ from the base of operation. This establishes a combustion zone in the top of the fragmented mass of oil shale particles below the blasting hole 30′. The introduction of an oxygen containing gas into the combustion zone for combustion of carbonaceous material in the oil shale produces combustion gas.

The air flow through the ignited combustible material 40 in the blasting hole 30′ also can be generated by operating the blower 61 in the access drift 18, which generates a lower gas pressure in the access drift 18 than in the base of operation 25. This draws air from the base of operation 25, down through the permeable mass of combustible material 40 in the blasting hole 30′, down through the fragmented mass 10, and out the access drift 18. The air drawn through the blasting hole 30′ generates a heated ignition gas used to establish a combustion zone and produce combustion gas in the fragmented mass below the blasting hole 30′.

As described above, any of the several blasting holes 30 can be used as a means of access to the fragmented mass to establish one or more combustion zones in the top of the retort. The top of such bore hole can be left open as air is drawn through the hole, or an air flow control valve 44 (see FIG. 3) can be connected to the top of a casing in such hole to provide means for controlling air flow through the hole from the base of operation.

Once such a combustion zone is established in the fragmented mass, the combustion zone is advanced laterally across the top of the retort. According to a method of this invention, the combustion zone initiated below the first blasting hole 30′ is advanced laterally across the top of the fragmented mass by the gas flow generated by the blower 46. The blower withdraws combustion gas from the fragmented mass which causes combustion gas to flow across the upper portion of the fragmented mass to spread the combustion zone laterally in the fragmented mass. The lateral gas flow across the top of the fragmented mass spreads the combustion zone from the vicinity of the first blasting hole 30' toward the second blasting hole 30''. Combustion gas drawn upwardly through the second blasting hole 30'' is carried away from the base of operation by the conduit 47 for disposition. The gas pressure differential generated between the first and second blasting holes can generate lateral gas flow over a relatively wide area of the retort between the two blasting holes which, in turn, spreads the combustion zone laterally over such a relatively wide area. That is, the combustion zone does not spread over an area limited only to a relatively narrow path between the first and second blasting holes. The combustion zone also tends to propagate laterally by means of conductive and radiative heat transfer. Further, the lateral gas flow at the top of the fragmented mass generated by the blower 46 tends to minimize downward advancement of the combustion zone while the combustion is being spread laterally over the top of the retort.

The gas pressure on the suction side of the second blasting hole 30'' is less than that in the base of operation to inhibit any chance that toxic substances present in the combustion gas flowing through the conduit 47 will enter the base of operation 25.

The blower 46 can be used to draw combustion gas across a relatively wide radially extending area of fragmented mass. Thus, a number of blasting holes located in a pattern around the second blasting hole 30'' can be used for initiating corresponding combustion zones spaced radially away from the second blasting hole 30''; and the blower 46 can be used to generate gas flow for spreading the combustion zones laterally across the top of the fragmented mass toward the second blasting hole 30''. Alternatively, the blower 46 or the conduit 47 can be connected to other blasting holes 30, or several of such blowers 46 or conduits 47 can be used to generate lateral gas flow across selected top portions of the fragmented mass in order to spread such combustion zones over essentially the entire top portion of the fragmented mass immediately below the sill pillar.

Once the combustion zone is established across the top of the fragmented mass, the combustion zone is advanced downwardly through the fragmented mass for retorting the oil shale. The combustion zone is advanced downwardly through the fragmented mass by withdrawing combustion gas from the production level access drift 18. The blower 61 in the access drift produces a lower gas pressure in the access drift than in the base of operation to draw air from the base of operation into the blasting holes and into the top of the fragmented mass to advance the combustion zone. During retorting, gas flow through each of the bore holes can be separately monitored and controlled from the base of operation for proper retort operation.

The method of this invention can be used to establish a combustion zone across the top of a retort in a shorter time than self-propagation of a combustion zone laterally across the top of the retort. The amount of auxiliary equipment required to establish the combustion zone is relatively minimal when using the method of this invention.

This method can be used to establish a combustion zone across the top of the fragmented mass in an in situ oil shale retort. When the retort is filled with a fragmented permeable mass of particles containing oil shale. With a retort filled with a fragmented mass, sloughing of formation above the top of the mass is minimized, and there can be higher recovery of hydrocarbon products than can be obtained from a retort having the same volume, but only being partially filled with particles containing oil shale. A retort filled with a fragmented mass also facilitates sensing whether the combustion zone has spread across the top of the fragmented mass.

What is claimed is:

1. A method of recovering liquid and gaseous products from an in situ oil shale retort in a subterreanean formation containing oil shale, the retort containing a fragmented permeable mass of formation particles containing oil shale, and in which the formation includes a means of access to a lower portion of the fragmented mass, an open base of operation at an elevation above the top of the fragmented mass, a horizontal sill pillar of unfragmented formation between the top of the fragmented mass and the bottom of the base of operation, and a plurality of bore holes extending through the sill pillar from the base of operation to the fragmented mass, the method including the steps of:

establishing a combustion zone in an upper portion of the fragmented mass adjacent the bottom of a first one of the bore holes through the sill pillar; and withdrawing gas from a second bore hole through the sill pillar to draw gas downwardly through the first bore hole through the sill pillar, across an upper portion of the fragmented mass, and up through the second bore hole so that gas flows across the upper portion of the fragmented mass and spreads the combustion zone across the fragmented mass.

2. The method according to claim 1 including generating a gas pressure differential between the first bore hole and the second bore hole to cause gas to flow downwardly through the first bore hole, across the upper portion of the fragmented mass, and up through the second bore hole.

3. The method according to claim 1 in which air is drawn from the base of operation into the first bore hole.

4. The method according to claim 3 including operating a blower connected to the second bore hole to withdraw gas from the second bore hole so that gas pressure in the second bore hole is less than that in the base of operation.

5. The method according to claim 1 including igniting the combustion zone through the first bore hole from a location within the base of operation.

6. The method according to claim 1 including withdrawing gas from a plurality of bore holes spaced apart across the width of the sill pillar to spread the combustion zone across the fragmented mass.

7. The method according to claim 1 in which gas is withdrawn from the second bore hole by producing a lower gas pressure in the second bore hole than in the base of operation for drawing gas from the base of operation, down through the first bore hole, across the upper portion of the fragmented mass, and up through the second bore hole.

8. The method according to claim 1 including introducing a combustible material to the fragmented mass through the first bore hole, and igniting the combustible material to establish a combustion zone in the fragmented mass.

9. The method according to claim 8 in which the ignited combustible material generates a heated ignition gas, and including contacting the fragmented mass with the heated ignition gas to establish the combustion zone in the fragmented mass.

10. The method of claim 1 further comprising the step of withdrawing gas from the retort adjacent the bottom boundary of the fragmented mass for advancing the combustion zone downwardly through the fragmented mass after the combustion zone spreads across an upper portion of the fragmented mass.

11. The method according to claim 1 including producing a lower gas pressure adjacent the lower portion of the fragmented mass than the gas pressure adjacent the upper portion of the fragmented mass to pull gas downwardly through the fragmented mass to advance the combustion zone toward the lower portion of the fragmented mass after the combustion zone spreads across the upper portion of the fragmented mass.

12. A method for establishing a combustion zone in an in situ oil shale retort in a subterreanean formation containing oil shale, in which the retort comprises a fragmented permeable mass of formation particles containing oil shale, said fragmented mass having top, bottom and side boundaries, and in which the formation includes a means of access in communication with a lower portion of the fragmented mass, an open base of operation above the top boundary of the fragmented mass, a horizontal sill pillar of unfragmented formation between the top of the fragmented mass and the bottom of the base of operation for effective access to substantially the entire horizontal cross-section of the fragmented mass, and a plurality of bore holes extending from the base of operation through the sill pillar to the top boundary of the fragmented mass, the method comprising the steps of:

establishing a combustion zone in the fragmented mass below at least a first one of said bore holes; and generating a gas pressure differential between such a first bore hole and at least a second one of said bore holes to draw gas down through such a first bore hole, across an upper portion of the fragmented mass, and up through such a second bore hole so that the gas flows across the upper portion of the fragmented mass and spreads the combustion zone across the fragmented mass.

13. The method according to claim 12 in which said gas pressure differential is produced by drawing gas up through such a second bore hole for drawing air from the base of operation down through such a first bore hole, and across the upper portion of the fragmented mass.

14. The method according to claim 13 including igniting the combustion zone in the fragmented mass through such a first bore hole from a location within the base of operation.

15. The method according to claim 12 in which the gas pressure differential is produced by operating a blower connected to such a second bore hole to withdraw gas from the second bore hole so that gas pressure in the second bore hole is less than that in the base of operation.

16. The method according to claim 12 including establishing a plurality of combustion zones in the fragmented mass below a plurality of such bore holes, and generating a gas pressure differential between such a second bore hole and said plurality of bore holes to spread the combustion zones across the fragmented mass.

17. The method according to claim 16 in which said plurality of bore holes are located so as to spread a combustion zone laterally across the horizontal cross-section of the fragmented mass toward such a second bore hole.

18. The method of claim 12 further comprising the step of withdrawing gas from the retort adjacent the bottom boundary of the fragmented mass for advancing the combustion zone downwardly through the fragmented mass after the combustion zone spreads across an upper portion of the fragmented mass.

19. The method according to claim 12 including producing a lower gas pressure adjacent the bottom boundary of the fragmented mass than the gas pressure adjacent the top boundary of the fragmented mass to pull gas downwardly through the fragmented mass to advance the combustion zone toward the bottom of the fragmented mass after the combustion zone spreads across the upper portion of the fragmented mass.

20. A method for igniting an in situ oil shale retort in a subterranean formation containing oil shale, the retort being defined by top, bottom and side boundaries of unfragmented formation and containing a fragmented permeable mass of formation particles containing oil shale, the method comprising the steps of:

establishing a combustion zone at a first point in the fragmented mass adjacent the top boundary;

introducing an oxygen containing gas into the fragmented mass in the combustion zone for combustion of carbonaceous material in oil shale and for producing combustion gas;

withdrawing combustion gas from the fragmented mass at a second point adjacent the top boundary of the retort, said second point being within the side boundaries of the retort and at a location remote from the combustion zone for advancing the combustion zone laterally in the fragmented mass; and thereafter withdrawing combustion gas from the fragmented mass adjacent the bottom boundary of the retort for advancing the combustion zone downwardly through the fragmented mass.

21. The method according to claim 20 including forming first and second bore holes through unfragmented formation to an upper portion of the fragmented mass, establishing a combustion zone in the fragmented mass near the first bore hole, introducing air to the fragmented mass through the first bore hole, and withdrawing combustion gas from the second bore hole to advance the combustion zone laterally in the fragmented mass.

22. The method according to claim 21 in which the first bore hole is open to a source of oxygen containing gas above said unfragmented formation, and including producing a lower gas pressure in the second bore hole than the gas pressure of said source of oxygen containing gas.

23. The method according to claim 20 including producing a lower gas pressure adjacent the bottom boundary of the retort than the gas pressure adjacent the top boundary of the retort to pull combustion gas through the fragmented mass to advance the combustion zone toward the bottom of the fragmented mass.

* * * * *